US005271952A

United States Patent [19]

Liang et al.

[11] Patent Number: 5,271,952

[45] Date of Patent: Dec. 21, 1993

[54] ANTI-STATIC ANTI-BACTERIAL FIBERS

[75] Inventors: Paul M. Liang; Frank Tsai, both of Taipei, Taiwan

[73] Assignee: RCS Technology Corporation, Taipei, Taiwan

[21] Appl. No.: 912,182

[22] Filed: Jul. 13, 1992

Related U.S. Application Data

[62] Division of Ser. No. 568,228, Aug. 16, 1990, Pat. No. 5,190,788.

[51] Int. Cl.[5] ..... B05D 3/12

[52] U.S. Cl. ..... 427/2; 427/121; 427/126.1; 427/343; 427/434.6

[58] Field of Search ..... 427/126.1, 434.6, 2, 427/121, 343

[56] References Cited

U.S. PATENT DOCUMENTS

| | | | |
|---|---|---|---|
| 4,267,233 | 5/1981 | Tanaka et al. | 427/400 |
| 4,746,541 | 5/1988 | Marikar et al. | 427/126.1 |
| 4,755,394 | 7/1988 | Aoki et al. | 427/123 |
| 4,756,926 | 7/1988 | Yamada et al. | 427/41 |
| 4,781,971 | 11/1988 | Marikar et al. | 428/212 |
| 4,868,008 | 9/1989 | Marikar et al. | 427/126.1 |
| 5,017,420 | 5/1991 | Marikar et al. | 427/126.1 |

*Primary Examiner*—Janyce Bell

*Attorney, Agent, or Firm*—James D. Hall; Thomas J. Dodd; R. Tracy Crump

[57] ABSTRACT

A method of producing fibers which are electrically conductive and which also exhibit anti-bacterial properties. The method involves treating the fibers in one or more baths which contain a solution of copper ions and an anti-bacterial compound such as iodine. The resulting fibers with the adsorbed copper and iodine ions exhibit the desired properties when dried.

5 Claims, No Drawings

ANTI-STATIC ANTI-BACTERIAL FIBERS

This is a divisional of copending applicaition Ser. No. 07/568,228, filed on Aug. 16, 1990 now U.S. Pat. No. 3,190,788.

FIELD OF THE INVENTION

This invention relates to conductive fibers and a method for producing conductive fibers, and will have special application to conductive fibers which also exhibit anti-bacterial properties.

BACKGROUND OF THE INVENTION

The major health problems associated with video display terminals (VDTs) can be traced emanation of electromagnetic radiation, static electricity, and airborne bacteria. Any of the foregoing phenomena can cause severe health problems for the VDT operator, particularly over a period of prolonged exposure.

The problem of EMR and static electricity emanations, as well as other problems have been reduced or eliminated by the development of electrically conductive screens which fit over the viewing screen of the VDT to reduce or eliminate harmful radiation emanations. Some of these screens and methods for producing them are seen in U.S. Pat. Nos. 4,364,739; 4,410,593; 4,468,702; 4,661,376; 4,760,456; and 4,819,085.

One heretofore unlooked at problem is the transmission of airborne bacteria from the VDT screen to the operator. This problem is of prime concern when a particular VDT is likely to have several users during the course of a day. One operator infected with a particular airborne virus can transmit that virus to several other operators using the same terminal, with predictable results.

Also, the growth of bacteria in fabrics made from certain fibers can damage the fibers due to the growth of moss. Currently, textile manufacturers utilize quaternary ammonium salts to inhibit bacterial growth, but these compounds are water soluble, the protection afforded is only temporary in nature.

SUMMARY OF THE INVENTION

The fibers of this invention are treated in such a manner so as to render a VDT screen both anti-static and anti-bacterial in nature. Plains fibers, usually acrylic or modacrylic monofilament fibers, are treated in a bath which contains an aqueous solution of divalent copper ions and a reducing agent capable of converting them to monovalent ions.

The bath also includes an iodine containing compound which bonds readily to the monovalent copper ions to form copper (I) iodide (CuI). The CuI is adsorbed onto the fibers to render them both anti-static and, due to the presence of the iodine ions, anti-bacterial. Two separate baths may also be used in the treatment of the fibers.

The fibers produced by this invention are typically used to manufacture anti-static, anti-bacterial fabrics used in making socks, cloth or other textile products which possess the above properties.

Accordingly, it is an object of this invention to provide for a method of treating fibers to give the fibers both anti-static and anti-bacterial properties.

Another object is to provide a method of treating previously non-conductive fabric with a solution of copper and iodine.

Another object is to provide fibers which can be woven into a framed screen and which possess the properties above described.

Other objects will become apparent upon a reading of the following description.

DESCRIPTION OF THE PREFERRED EMBODIMENT

The preferred embodiments and methods herein described are not intended to be exhaustive or to limit the invention to the precise forms or steps disclosed. They are chosen and described to explain the principles thereof, and their application and practical use so that others skilled in the art might follow their teachings.

In the preferred embodiment, the fibers used are preferably from the acrylic or modacrylic family, although other types of fabrics could be used. Initially, the fabric fibers are electrically nonconductive, with electrical resistances approaching $10^{10}$ ohms. Untreated fibers, if woven into a screen and placed in front of a VDT would cure some of the distortion problems inherent in the terminal, but would be essentially useless in diffusing static electricity and EMR emanations as well as the flow of airborne bacteria. A screen of this type is shown in U.S. Pat. No. 4,819,085 issued Apr. 4, 1989 which is incorporated herein by reference.

To impart electrical conductivity to the screen, the fibers are immersed in a bath which contains a solution of aqueous metal ions. In the preferred method, monovalent copper ions which have been reduced from divalent ions are used because of their ability to be readily adsorbed onto the fibers.

A bath is prepared which contains a solution of divalent copper ions usually $CuCl_2$, $CuSO_4$ or $Cu(NO_3)_2$ and a reducing agent which is preferably one or more of the following: copper metal, sodium formate, ferrous sulfate, sodium bisulfite, sodium hypophosphite, ammonium vanadate, hydroxylamine sulfate, furfural, glucose and hydroxylamine. Other known reducing agents may be substituted or added if desired. The teachings of a bath immersion method of this sort are best described in detail in U.S. Pat. Nos. 4,336,028 and 4,410,593. By following these teachings, the fibers are rendered sufficiently conductive to diffuse a good portion of the static electricity and EMR emanating from a VDT.

In the method of this invention an additional ingredient, namely an iodine-containing compound, is utilized. The method may involve a two bath treatment, with the fibers first immersed in a solution of copper ions, then after washing, the copper impregnated fibers are immersed in an iodine solution. Alternatively, a one bath treatment of copper ions and iodine ions may be employed.

An amount of sodium thiosulfate ($Na_2S_2O_3$) can be employed in the one bath treatment or two bath treatment system. Sulfur ions are compatible with iodine ions. The fibers are impregnated with copper ions first and then the negative ions take the adsorption. The various results of color, conductivity and bacteria inhibition are obtained by changing the concentration of $S^{-2}$, $I^-$ and $Cu^{-2}$.

The bath can also optionally contain an acid or a salt for adjusting the pH of the bath. Suitable acids and salts for this purpose are inorganic acids such as $H_2SO_4$, etc. or organic acids such as citric acid, etc.

The temperature of the treatment bath is preferably within the range of 50° C. to 120° C. At high treatment temperatures, the strength of fibers are liable to deteriorate although the time of treatment will be shorter. At lower temperatures, the time of treatment may be undesirably long.

After the fibers have been treated in the bath(s), they are normally dried and then woven into fabrics which can be used in making socks or other articles of clothing or can be woven into screens. Some screens are shown and described in U.S. Pat. Nos. 4,760,456, issued Jul. 26, 1988 and 4,819,085, issued Apr. 5, 1989.

The iodine-containing compound will preferably be one of the following, but others can no doubt be used with similar results: potassium iodide, potassium iodate, sodium iodide, sodium iodate, and many other metal iodides and iodates in which the $I^-$ or $IO_3^-$ ion can be liberated. Various results in conductivity and bacterial inhibition are obtained by changing the concentrations of the copper, sulfur and iodine ions in the solutions, and, as such, this invention is not limited to specific concentrations.

The following examples illustrate the methods used to form the anti-static, anti-bacterial fibers of this invention.

EXAMPLE 1

An acrylic fabric swatch measuring 2.5 cm. by 1.5 cm. was thoroughly scoured and immersed in a heated bath which contained $CuCl_2$ and $NaHSO_3$. The amount of each compound in the solution relative to fabric weight was 30% $CuCl_2$ and 15% $NaHSO_3$ and the fabric-to-solution weight was 1:40. The bath containing the fabric was gradually heated to 90° C. and the fabric immersed for 60 minutes. The fabric was then removed and washed with deionized water. The treated fabric was then immersed in a heated bath containing KI. The bath was heated to 90° C. and the fabric immersed therein for one hour. The concentration of KI was 30% of the initial weight of the fabric added to water. The fabric was removed from the bath and washed again in water. The fabric exhibited a pale yellowish color and tests confirmed that 10.2% of its weight was CuI which had adsorbed onto the fibers. Electrical resistance and anti-bacterial properties are listed in the charts 1-6 at the conclusion of Example 6.

EXAMPLE 2

Acrylic fabric was immersed in a heated bath containing 0.1 liter of water, an 85 $cm^2$ copper plate (relative to water) 3% by weight of $CuCl_2$ and 0.15% by weight (relative to water) of $H_2SO_4$. The weight of the fabric in relation to the water was 1:40. The fabric was immersed in the bath at 90° C. for 30 minutes, removed and washed. The treated fabric was then immersed in a heated bath (90° C.) for one hour. The bath contained 3% by weight KI in relation to water. After removal the fabric was washed and exhibited a pale yellowish color. Tests confirmed that 11.5% of the fabric weight was adsorbed CuI. Electrical conductivity and anti-bacterial properties are listed in the charts.

EXAMPLES 3-6

A bath was prepared which contained an aqueous solution of the compounds listed in the tables below. In each case, the fabric was immersed in the heated (90° C.) bath for one hour, removed and washed, then tested for CuI and CuS content, electrical conductivity and anti-bacterial properties. All chemical percentages are by weight in relation to the fabric weight.

| Example Number | $CuCl_2$ | $NaHSO_3$ | $Na_2S_2O_3$ | KI | Fabric Color |
|---|---|---|---|---|---|
| 3 | 30% | 15% | 27% | 3% | Green |
| 4 | 30% | 15% | 9% | 21% | Brown |
| 5 | 30% | 15% | 3% | 27% | Light Brown |
| 6 | 30% | 15% | 1% | 29% | Yellow |

The testing for electrical conductivity was a standard test of the fibers after treatment. The anti-bacterial test was conducted in the following manner.

First, cultures of *Staphylococcus aureus* (*S. aureus*) and *Trichophyton rubrum* (*T. rubrum*) were prepared and activated in the following fashion. The *S. aureus* was activated twice on nutrient agar for 24 hours at 35° C. and transferred to a nutrient broth. After 18 hours, the broth was centrifugal and the bacteria collected and washed with an average count of about $10^6$ CFU/ml after dilution. The *T. rubrum* was prepared and activated on mycological agar for 5-7 days at 25° C., then transferred to another mycological agar surface and diluted to about $10^5$ CFU/ml.

Next the fabric to be tested (a one inch square) was added into 0.5 ml. of *S. aureus*, or 10 ml. of *T. rubrum* solution. After 18 hours the bacteria counts were made on nutrient agar for the *S. aureus*, and on potato dextrose agar for *T. rubrum*. The following charts indicate the electrical conductivity and anti-bacterial properties for the fabrics treated according to examples 1-6. An untreated control piece was also cut for each example and examined after 18 hours.

| Example Number | Bacteria Type | Initial Count CFU/$in^2$ | Final Count CFU/$in^2$ | Control CFU/$in^2$ | Efficiency |
|---|---|---|---|---|---|
| 1 | *S. Aureus* | $1.3 \times 10^6$ | 0 | $7.1 \times 10^6$ | 100% |
| | *T. Rubrum* | $2.3 \times 10^5$ | 56 | $3.2 \times 10^5$ | 99.98% |
| 2 | *S. Aureus* | $1.3 \times 10^6$ | 0 | $7.1 \times 10^6$ | 100% |
| | *T. Rubrum* | $2.3 \times 10^5$ | 40 | $3.2 \times 10^5$ | 99.98% |
| 3 | *S. Aureus* | $1.1 \times 10^6$ | 320 | $6.2 \times 10^6$ | 99.97% |
| | *T. Rubrum* | $1.6 \times 10^5$ | 620 | $1.3 \times 10^5$ | 99.61% |
| 4 | *S. Aureus* | $1.1 \times 10^6$ | 340 | $6.2 \times 10^6$ | 99.97% |
| | *T. Rubrum* | $1.6 \times 10^5$ | 380 | $1.3 \times 10^5$ | 99.76% |
| 5 | *S. Aureus* | $1.1 \times 10^6$ | 29 | $6.2 \times 10^6$ | 99.99% |
| | *T. Rubrum* | $1.6 \times 10^5$ | 62 | $1.3 \times 10^5$ | 99.96% |
| 6 | *S. Aureus* | $1.1 \times 10^6$ | 0 | $6.2 \times 10^6$ | 100% |
| | *T. Rubrum* | $1.6 \times 10^5$ | 71 | $1.3 \times 10^5$ | 99.96% |

The electrical conductivity of each treated fabric was as follows.

| Example | Initial Resistance (r) | Final Resistance (r) | CuI (CuS) Content |
|---|---|---|---|
| 1 | $10^{13}$ | $1 \times 10^8$ | 10.2% |
| 2 | $10^{13}$ | $2 \times 10^4$ | 11.5% |
| 3 | $10^{13}$ | 500 | 11.9% |
| 4 | $10^{13}$ | $8 \times 10^3$ | 11.5% |
| 5 | $10^{13}$ | $1 \times 10^5$ | 10.9% |
| 6 | $10^{13}$ | $8 \times 10^7$ | 10.4% |

It can be seen from the foregoing examples that electrical resistance and anti-bacterial efficiency can be altered by changing the solution concentrations which were intended to illustrate and not limit the invention to the parameters disclosed. Particularly, the material concentrations can be varied to alter color, resistance, and bacteria control, and the bath temperatures can also be altered between about 50° C. and 120° C. as above noted. The one bath system used in Examples 3-6 can also be converted into a two bath system as in Examples 1-2. The invention is not limited to the above-given details, and may be modified within the scope of the following claims.

We claim:

1. A method of treating fibers to render the fibers electrically conductive and anti-bacterial, said method comprising the steps of:

a) preparing a bath of an aqueous solution containing an aqueous solution of divalent copper ions, and a reducing agent sufficient to convert said divalent copper ions into monovalent copper ions, sodium thiosulfate, and iodide ions;

b) immersing said fibers in said bath wherein copper iodide is adsorbed onto said fibers; and c) removing said fibers from said bath.

2. The method of claim 1 wherein said bath is heated above room temperature prior to step (b).

3. The method of claim 2 wherein step (b) includes immersing said fibers in said bath at between 50° C.-120° C.

4. The method of claim 1 wherein said fibers are washed after step (c).

5. The method of claim 1 wherein said sodium thiosulfate is added to said bath at between 0%-29% by weight relative to the weight of the fibers.

* * * * *